US012790808B2

(12) United States Patent
Gallocher et al.

(10) Patent No.: US 12,790,808 B2
(45) Date of Patent: Nov. 10, 2026

(54) REINFORCED MODULAR STEEL-CONCRETE STRUCTURES

(71) Applicant: MODULAR WALLING SYSTEMS HOLDINGS LIMITED, Renfrew (GB)

(72) Inventors: Stewart Gallocher, Renfrew (GB); Simon Bingham, Renfrew (GB)

(73) Assignee: MODULAR WALLING SYSTEMS HOLDINGS LIMITED, Renfrew (GB)

( * ) Notice: Subject to any disclaimer, the term of this patent is extended or adjusted under 35 U.S.C. 154(b) by 337 days.

(21) Appl. No.: 18/255,090

(22) PCT Filed: Dec. 2, 2021

(86) PCT No.: PCT/EP2021/083950
§ 371 (c)(1),
(2) Date: May 30, 2023

(87) PCT Pub. No.: WO2022/117718
PCT Pub. Date: Jun. 9, 2022

(65) Prior Publication Data

US 2024/0018770 A1 Jan. 18, 2024

(30) Foreign Application Priority Data

Dec. 2, 2020 (GB) ..... 2018986

(51) Int. Cl.
*E04B 1/14* (2006.01)
*E04B 2/86* (2006.01)
*E04B 1/35* (2006.01)

(52) U.S. Cl.
CPC ..... *E04B 1/14* (2013.01); *E04B 2/8629* (2013.01); *E04B 2001/3583* (2013.01)

(58) Field of Classification Search
CPC ... E04B 1/14; E04B 2/8629; E04B 2001/3583
See application file for complete search history.

(56) References Cited

U.S. PATENT DOCUMENTS 5,325,651 A * 7/1994 Meyer ..... E04C 3/32 52/696
5,797,235 A 8/1998 Bowerman et al.
(Continued)

FOREIGN PATENT DOCUMENTS

CN 103912116 7/2014
JP H10-331568 A 12/1998
(Continued)

OTHER PUBLICATIONS

International Search Report and Written Opinion issued in the PCT Application No. PCT/EP2021/083950.

*Primary Examiner* — Patrick J Maestri
(74) *Attorney, Agent, or Firm* — Foley & Lardner LLP

(57) ABSTRACT

A construction element is provided. The construction element comprises a base panel and two substantially perpendicular sidewall panels which together define a U-shaped channel having an internal cavity. At least one of the panels includes at least one panel opening dimensioned to allow the passage of a reinforcement or stabilising material into the internal cavity. The construction element further comprises at least one support plate (70) having first and second ends fixed to respective sidewall panels and extending substantially perpendicular to the sidewall panels across the channel so as to provide support to the sidewall panels.

19 Claims, 9 Drawing Sheets

(56) References Cited

U.S. PATENT DOCUMENTS

| | | | | |
|---|---|---|---|---|
| 2003/0093969 | A1* | 5/2003 | Saldana | E04C 3/07 52/715 |
| 2008/0086963 | A1* | 4/2008 | Proffitt, Jr. | E04B 2/58 52/223.6 |
| 2008/0245013 | A1* | 10/2008 | Carlisle | E04B 2/8629 52/436 |
| 2020/0123769 | A1* | 4/2020 | Darwell | E04B 2/8652 |

FOREIGN PATENT DOCUMENTS

| | | |
|---|---|---|
| JP | 2014-088658 | 5/2014 |
| WO | WO-2013/117892 | 8/2013 |
| WO | WO-2015/106474 | 7/2015 |

* cited by examiner

REINFORCED MODULAR STEEL-CONCRETE STRUCTURES

CROSS-REFERENCE TO RELATED APPLICATIONS

This application claims the benefit of priority to International Application No. PCT/EP2021/083950, filed on Dec. 2, 2021, which claims the benefit of Great Britain Patent Application No. 2018986.6, filed Dec. 2, 2020, all of which are hereby incorporated by reference in their entirety.

FIELD OF THE INVENTION

The present invention relates to the field of reinforced modular structures such as basemats, foundations, floors, walls, and roofs, for example. These structures are formed from a plurality of individual structural elements which are assembled together to form the structure.

BACKGROUND OF THE INVENTION

When building large structures it is beneficial to reduce labour costs and minimise build times. This is particularly relevant to the construction of nuclear power plants where such efficiencies are necessary to allow nuclear power to become a more viable and realistic alternative fuel source to fossil fuels or other low capacity alternative sources.

Nuclear power plants and other sensitive structures including nuclear waste processing and/or storage facilities are required to withstand natural events such as earthquakes and hurricane force winds, and to contain large over-pressures. This necessitates substantial reinforcement of the building structure. Known reinforcement means employ a complex and expensive assembly of layered planar steel plates braced apart by a separate internal lattice of stiffening members and/or tie bars and/or shear studs. A highly specialised and skilled work force, which itself is expensive and difficult to source, is required to assemble those presently available solutions. Consequently, there exists a need for a simpler, more efficient and more cost-effective means of providing structural reinforcements to the nuclear and other industries.

One solution proposed by the same applicant can be seen in WO2013/117892. WO'892 discloses a building component comprising a modular assembly of a plurality of building reinforcements, where the reinforcements are each formed from two L-shaped elements so as to define a U-shaped channel. The base panel of one U-shaped channel is fastened along distal edges of both sidewall panels of an adjacent U-shaped channel so as to form a lid closing the open top of the adjacent U-shaped channel. A plurality of the reinforcements are fastened together in this way so as to form the component, which may be a wall, ceiling or floor.

Where groups of such components are brought together, such as when forming a joint between a wall and supporting floor, the weight of the wall component is brought to bear on the floor. This may cause one or more sidewall panels forming the floor component to bend or buckle.

Another potential issue with such components arises when they are filled with concrete. Pockets of air may be trapped within the individual elements as the concrete fills the internal space defined by an element. These air pockets can lead to weakened portions of the structure.

The fastening of the element is typically achieved by using welding, bonding and/or mechanical fasteners to form the modular assembly. Whilst this arrangement is an undoubted improvement upon the complex and expensive assemblies used before, the formed components still have to be attached to each other on site using one of these same fastening methods so as to form a resulting building or other structure. This means that it can still be a time-consuming process to form a building or other structure from a number of these reinforced components. Having to fasten the components using welding, bonding or mechanical fixtures on site also limits the flexibility of the system, meaning that it may not be able to meet particular design requirements.

It is an aim of the present invention to obviate or mitigate one or more of these disadvantages of reinforced modular structures.

SUMMARY OF THE INVENTION

According to a first aspect of the present invention there is provided a construction element comprising:

- a base panel and two substantially perpendicular sidewall panels which together define a U-shaped channel having an internal cavity, wherein at least one of the panels includes at least one panel opening dimensioned to allow the passage of a reinforcement or stabilising material into the internal cavity; and
- at least one support plate having first and second ends fixed to respective sidewall panels and extending substantially perpendicular to the sidewall panels across the channel so as to provide support to the sidewall panels.

Preferably, the at least one support plate includes at least one support plate opening dimensioned to allow the passage of a reinforcement or stabilising material through the support plate.

Preferably, at least one of the sidewall panels includes a vent adapted to allow air to pass from inside the element to outside the element. The vent may be tapered such that it has a larger diameter on an outside surface of the sidewall panel than on an inside surface of the sidewall panel.

According to a second aspect of the present invention there is provided a construction element comprising:

- a base panel and two substantially perpendicular sidewall panels which together define a U-shaped channel having an internal cavity, wherein at least one of the panels includes at least one panel opening dimensioned to allow the passage of a reinforcement or stabilising material into the internal cavity; and
- wherein at least one of the sidewall panels includes a vent adapted to allow air to pass from inside the element to outside the element.

Preferably, the vent is tapered such that it has a larger diameter on an outside surface of the sidewall panel than on an inside surface of the sidewall panel.

Preferably, the construction element is formed from a steel plate having a thickness of between 6 mm and 25 mm.

The construction element may be formed from two separate L-shaped sections that are joined together to form the U-shaped channel. The two L-shaped sections may be shaped such that when they are joined together they define the at least one panel opening. The two L-shaped sections may be joined to one another by welding, bonding or mechanical fastening.

Preferably, an internal surface of at least one of the base and sidewall panels includes a plurality of shear studs projecting into the internal cavity.

According to a third aspect of the present invention there is provided a construction component comprising a modular assembly of a plurality of construction elements according to the first or second aspect of the present invention, wherein the base panel of one construction element is fastened along distal edges of both sidewall panels of an adjacent construction element so as to form the construction corn ponent.

The construction component may further comprise at least one tensioning duct adapted to receive a tensioning tendon, the at least one tensioning duct extending along the length of the component through the at least one panel opening in each construction element.

According to a fourth aspect of the present invention there is provided a method of forming a L- or T-shaped joint from first and second construction elements according to the first aspect of the invention, the method comprising:

determining first and second abutment locations where ends of the two sidewall panels of the first construction component will abut a sidewall panel of the second construction element when the joint is formed;

fixing a pair of support plates across the channel of the second construction element at the first and second abutment locations;

bringing the first and second construction elements together such that the two sidewall panels of the first construction element are substantially co-planar with the respective support plates of the second construction element; and fixing the first and second construction elements together.

The fixing steps may comprise welding, bonding or mechanically fastening the relevant components to one another.

According to a fifth aspect of the invention there is provided a construction component comprising a modular assembly of a plurality of construction elements attached to one another so as to form a substantially planar component, each construction element comprising a plurality of panels which together define an internal cavity, wherein at least one of the panels includes at least one opening dimensioned to allow the passage of a reinforcement or stabilising material into the cavity, and the component further comprises at least one tensioning duct adapted to receive a tensioning tendon, the at least one duct extending along the length of the component through the at least one opening in each construction element.

The construction component may further comprise a tensioning tendon located in the or each duct, the tendon selected from the group comprising a wire, a multi-wire strand, and a bar. The tendon may include first and second anchorages at either end thereof, the anchorages connectable to another construction component and/or a concrete surface.

According to a sixth aspect of the invention there is provided a method of constructing a structure, the method comprising the steps of:

forming a construction component in accordance with the fifth aspect of the present invention;

filling the internal cavities of the plurality of construction elements with concrete; and tensioning the tensioning tendon once the concrete has hardened.

According to a seventh aspect of the present invention there is provided a method of constructing a structure, the method comprising:

forming at least two construction components in accordance with the fifth aspect of the present invention;

arranging the at least two components such that they define the structure;

anchoring first and second ends of each tensioning tendon to outer surfaces of the at least two components;

initially tensioning the tendons so as to secure the at least two of the components to one another;

filling the internal cavities of the at least two construction components with concrete; and further tensioning the tendons once the concrete has hardened.

The structure may be a four sided structure, and the method preferably comprises:

forming four construction components in accordance with the fifth aspect of the present invention;

arranging the four components such that they define the base, first and second side walls and top of the structure;

locating a tensioning tendon in the at least one duct of the base and top components;

anchoring first and second ends of each tensioning tendon to outer surfaces of the first and second side walls;

initially tensioning the tendons so as to secure the base and roof to the first and second side walls;

filling the internal cavities of the plurality of construction components with concrete; and further tensioning the tendons once the concrete has hardened.

The step of arranging the components may include employing one or more temporary supports to temporarily hold the components in position, and the method further comprises the step of removing the temporary supports after the anchoring step.

According to an eighth aspect of the present invention there is provided a method of constructing a structure, the method comprising:

forming one or more construction components in accordance with the fifth aspect of the present invention;

arranging the one or more components upon a foundation so as to define a central core of the structure;

anchoring first and second ends of each tensioning tendon to the foundation and an upper surface of the or each component, respectively;

initially tensioning the tendons so as to secure the or each component to the foundation;

installing one or more support columns adjacent the central core;

attaching one or more support beams between the or each support column and the core;

filling the internal cavities of the one or more construction components with concrete; and further tensioning the tendons once the concrete has hardened.

BRIEF DESCRIPTION OF THE DRAWINGS

Preferred embodiments of the present invention will now be described, by way of example only, with reference to the accompanying drawings in which.

DETAILED DESCRIPTION OF THE DRAWINGS

Figure 1:
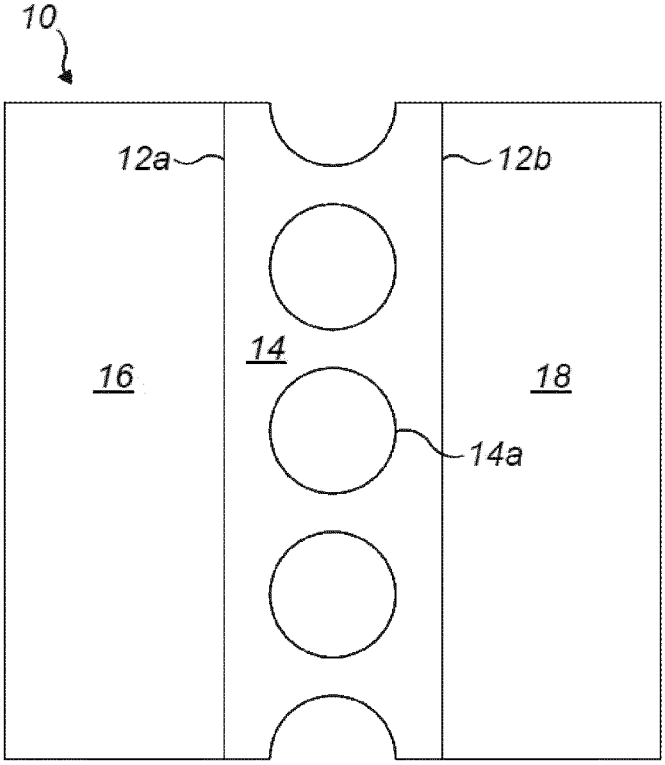
FIG. 1 shows a planar plate having fold lines and apertures from which a construction element is formed.

FIG. 1 shows a construction element in a two-dimensional pre-assembly condition before it is formed into a three-dimensional construction element. The construction element comprises a rectangular metallic plate 10 subdivided by two straight, parallel fold lines 12*a*, 12*b* to define three panels 14, 16, 18 of equal dimensions. Each panel lies in a common plane. The material of the plate is metal. Most preferably, the plate is formed from plate stainless steel or carbon steel. Each fold line 12*a*, 12*b* comprises a line of weakness formed by scoring, stamping or partially cutting into the surface of the metallic plate. The central panel 14 is provided with circular openings 14*a* equally spaced in a line along its length. The diameter of the openings 14*a* may be at least 50% of the width of the central panel 14 between the fold lines 12*a*, 12*b*.

Figure 2:
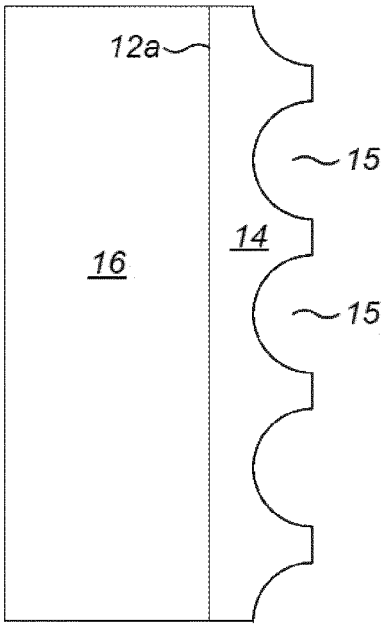
FIG. 2 shows a two-dimensional planar plate portion which represents one half of the construction element of FIG. 1.

FIG. 2 shows an alternative two-dimensional planar plate portion which represents one half of the construction element of FIG. 1. The plate portion is shaped such that it comprises a series of spaced semi-circular recesses 15 located along one edge of the panel 14.

Figure 3:
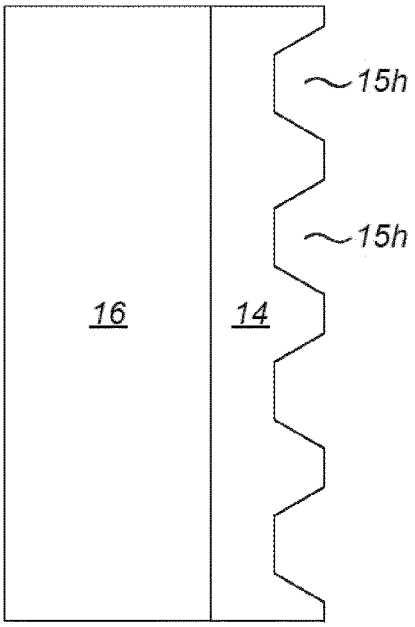
FIG. 3 shows an alternative two-dimensional planar plate portion representing one half of a construction element.

FIG. 3 shows a further alternative two-dimensional planar plate portion which also forms one half of a construction element (not shown). The plate portion is shaped such that it comprises a series of spaced hexagonal recesses 15*h* located along one edge of the panel 14.

Figure 4A:
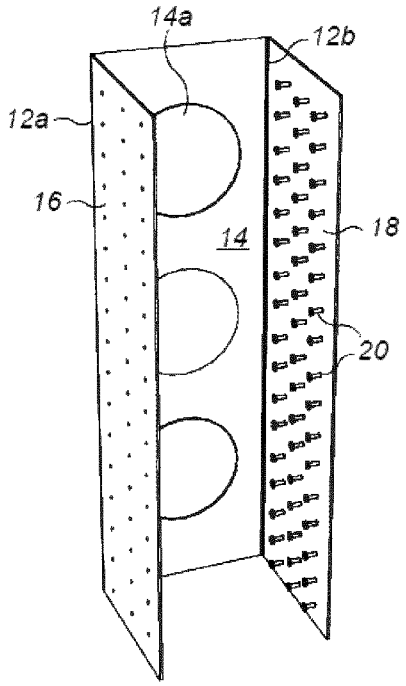
FIGS. 4*a-c* show two different three-dimensional construction elements and a construction component assembled from a series of individual construction elements fastened together.

FIG. 4*a* shows a three-dimensional construction element formed from a two-dimensional metallic plate 10 similar to that shown in FIG. 1. Sidewall panels 16, 18 have been deformed out of their initial common plane by forcible bending along their fold lines 12*a*, 12*b* so as to extend perpendicularly with respect to the base panel 14. The three-dimensional construction element therefore adopts a U-channel shape whereby the sidewall panels 16, 18 are opposed, substantially parallel and standing upright from the base panel 14 to define the U-channel. In the particular embodiment illustrated in FIG. 4*a*, an array of shear studs 20 are welded to the inwardly facing surfaces of the sidewall panels 16, 18. The shear studs may be Nelson® studs having heads which are enlarged relative to their shank widths.

The plate preferably has a thickness in the range of 6-25 mm, and is most preferably steel plate. When forming elements from this thickness of plate in particular it has been found that the process of manufacturing a three-dimensional three-panel construction element is made simpler by joining together two L-shaped two-panel halves. For example, two of the planar plate portions shown in FIG. 2 may be forcibly bent along their respective fold lines 12*a* so that each panel 14 extends perpendicularly with respect to its panel 16. The two L-shaped panels may then be orientated such that their semi-circular recesses 15 are aligned to form circular openings 14*a* and then fastened together by, for example, welding the edge portions lying intermediate each opening 14*a*. It will be appreciated that this method of manufacturing the U-shaped channels is more practicable than forming two bends in a single three-panel construction element using a mechanical press. A further advantage is the two planar plate halves can be manufactured from different grades of steel, e.g. stainless steel and carbon steel respectively.

The above process can also be employed using pairs of planar plate portions as shown in FIG. 3. The advantage of using planar plate halves having hexagonal recesses 15 is that wastage of the metallic plate material can be entirely eliminated during their manufacture when they are cut from a blank metallic plate.

Figure 4B:
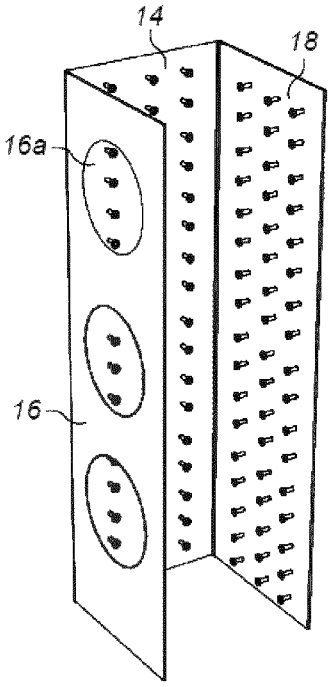

FIG. 4*b* shows an alternative three-dimensional construction element formed from a two-dimensional metallic plate 10 (not shown). Sidewall panels 16, 18 have been deformed out of their initial common plane so as to define the same U-channel shape as shown in FIG. 4*a*. However, the openings 16*a* are provided in a sidewall panel 16 rather than in the base panel 12.

Figure 4C:
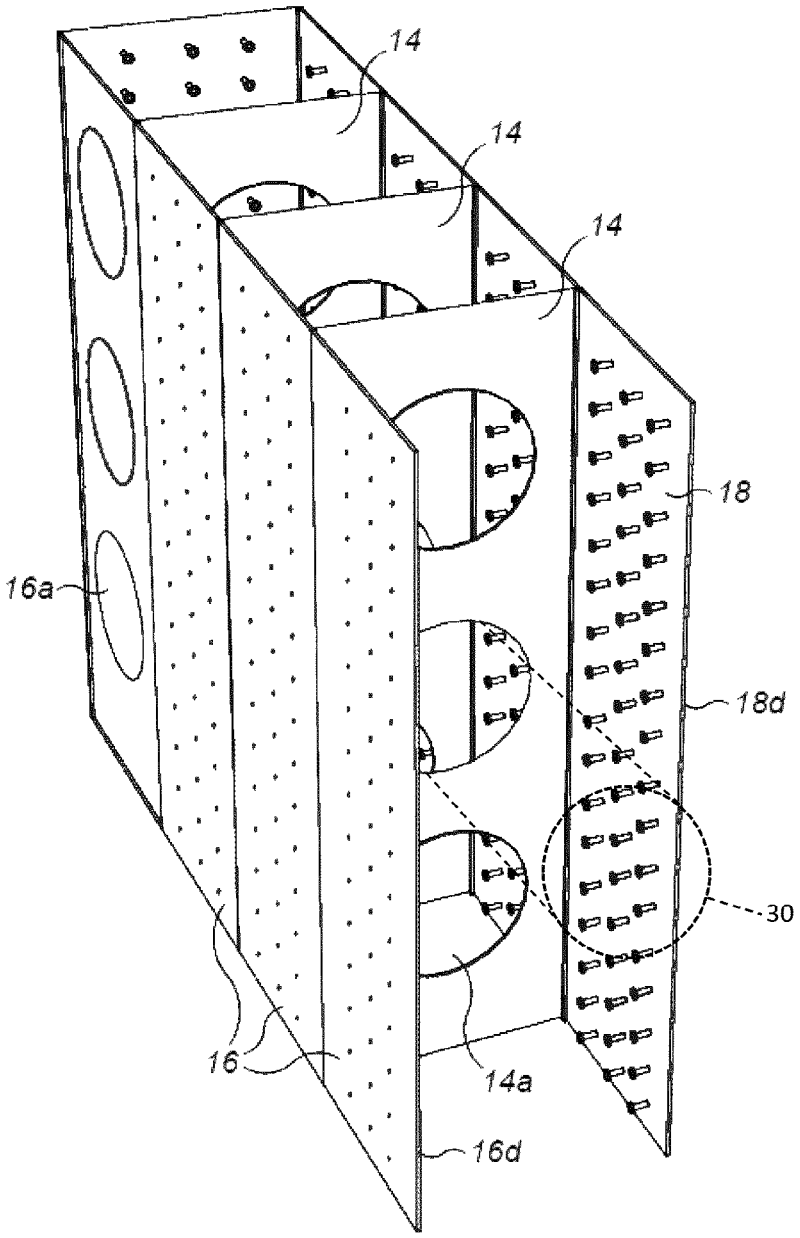

FIG. 4*c* shows a reinforced building component comprising three construction elements according to FIG. 4*a* and one of the construction elements of FIG. 4*b*. Typically, the construction elements are orientated such that they stand on their end and their panels 14, 16, 18 extend vertically. The individual construction elements are identically orientated and aligned so as to be fastened together in series by, for example, welding the distal edges 16*d*, 18*d* of one U-channel to the outer edges of the base panel 14 of another U-channel. In doing so, the adjoined sidewall panels 16, 18 present substantially planar exterior surfaces of a double-skinned assembly, and each base panel 14 closes the open top of the U-channel to which it is fastened.

When fastened together in this way the openings 14*a* are aligned to define an internal passage through the interior of the construction assembly between its opposing sidewalls 16, 18. A duct 30 may be provided in the building component, the duct running longitudinally along the length of the component through the passageway defined by the aligned openings 14*a*.

The construction element of FIG. 4*b* may act as a 'corner' element serving to change the direction of the internal passage by 90 degrees.

The exact shape, size and position of the openings 14*a*, 16*a* in the construction elements described above is not critical, provided that the selected reinforcement, stabilising material and/or duct is able to pass through. The sizes of the openings are also selected having regard to the required residual strength of the panels of the construction element, and the elimination or reduction of stress raisers. For example a concrete with coarse aggregate filler may require larger apertures than a fibre-filled resin.

Figure 5:
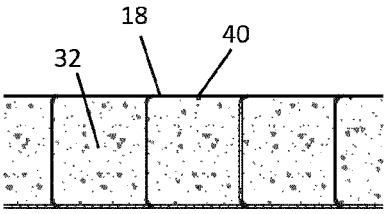
FIG. 5 is a sectional view through a construction component formed from the construction elements.

FIG. 5 shows a sectional view through a building component formed from a plurality of the construction elements of the kind illustrated in FIGS. 4*a* and 4*b*, where the attached elements have been filled with concrete 32. At least one of the elements has been modified so as to include a weep hole or vent 40 in one of its sidewall panels 18.

Figure 6A:
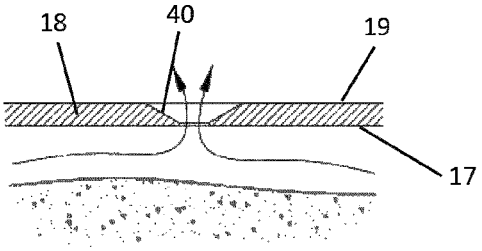
FIGS. 6*a-d* show various stages in the process of filling a construction component with concrete.

FIGS. 6*a-d* show how the weep hole 40 is utilised in the course of filling the plurality of elements with concrete. FIG. 6*a* shows how air is forced out of the element through the weep hole 40 from the interior of the element as concrete flows into the element via the opening(s) in the panels. The weep hole 40 tapers outwardly from an internal surface 17 of the panel 18 to an outer surface 19. In other words, the weep hole 40 has a greater diameter on the outer surface 19 than on the inner surface 17. Allowing air to escape the element in this way ensures that the element is completely filled with the concrete, with no air pockets or bubbles present inside the element.

Figure 6B:
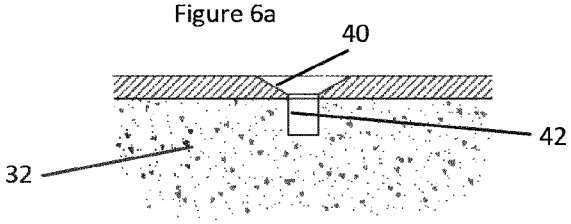
Figure 6C:
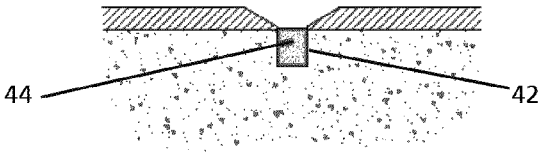
Figure 6D:
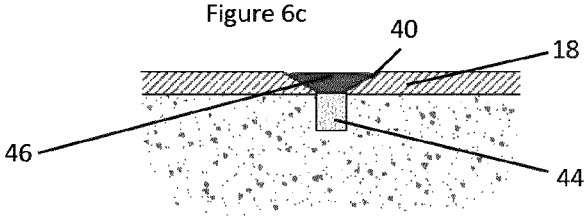

FIG. 6*b* shows the concrete 32 completely filling the element, as described above. Once the concrete 32 has hardened a hole 42 is drilled into the concrete via the weep hole 40. A ceramic plug 44 is then placed in the hole 42, as seen in FIG. 6*c*. Finally, a weld 46 is placed over the plug 44 in the weep hole 40 as seen in FIG. 6*d*. The weld 46 seals the panel 18 and ensures that nothing can pass out of the element via the weep hole 40.

Figure 7A:
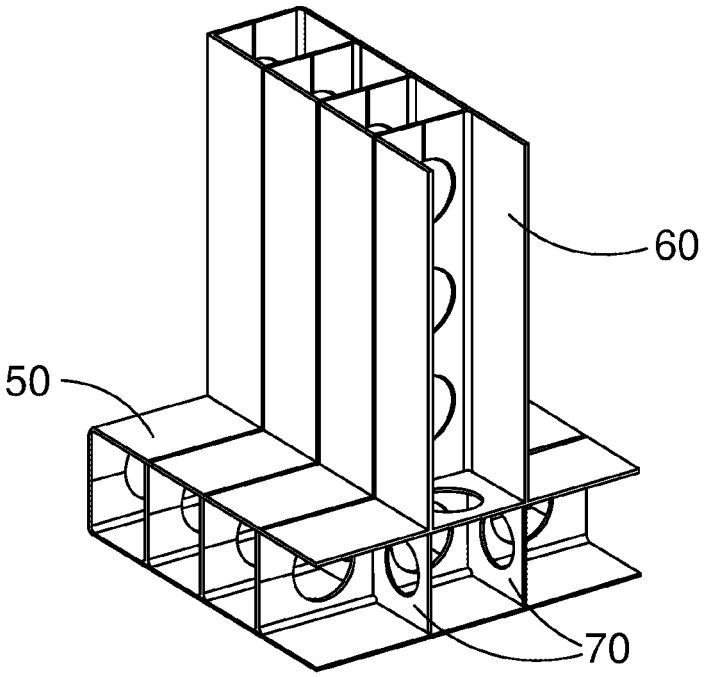
FIGS. 7*a-c* show perspective, side and end views of a joint formed from construction components.
Figure 7B:
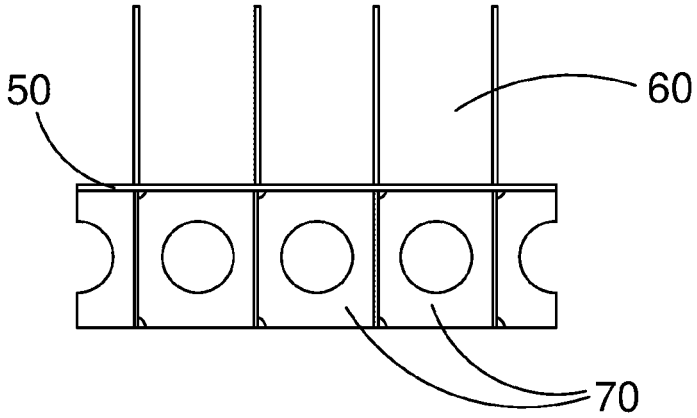
Figure 7C:
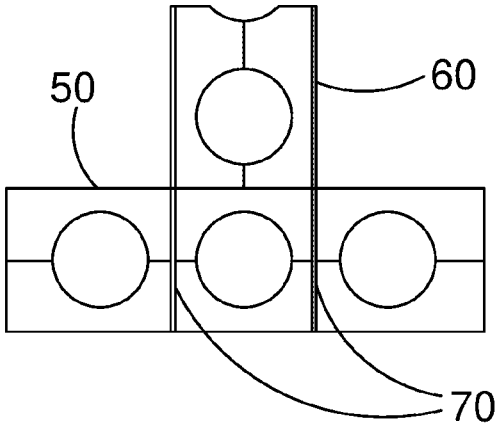

FIGS. 7*a-c* show views of a joint which may be formed between two building components formed in the manner described above. In this embodiment a T-shaped joint is formed between a horizontal component (e.g. a base or floor) 50 and a vertical component (e.g. a wall) 60. The elements which are attached to one another to form the horizontal and vertical components 50,60 are substantially the same as shown in FIGS. 4*a-c*.

In the course of designing the structure of which the components 50,60 form part the exact arrangement and positioning of the various components has already been established. This means that in order to give the joint additional strength diaphragm support plates can be attached to some or all of the elements where the two components meet one another. In the example shown in FIG. 7 pairs of diaphragm plates 70 are welded into the U-shaped channel of each element making up the horizontal component 50. The diaphragm plates 70 are attached to the horizontal elements at the longitudinal locations where the elements making up the vertical component 60 will abut the respective sidewall of the horizontal component 50. Thus, the diaphragm plates 70 are substantially co-planar with the sidewalls of the first element making up the vertical component 60 so as to give additional strength and support to the elements of the horizontal component 50 lying under the vertical component 60. One or both diaphragm plates in each pair may include openings for concrete flow as shown, or one or both may have no openings. Diaphragm plates of this kind may also be installed at any locations in the building components where reinforcement is needed. For example, if heavy plant is to be attached to a wall component, then diaphragm plates can be attached in the channels of one or elements making up that wall component, in the region where the plant is to be attached.

Figure 8A:
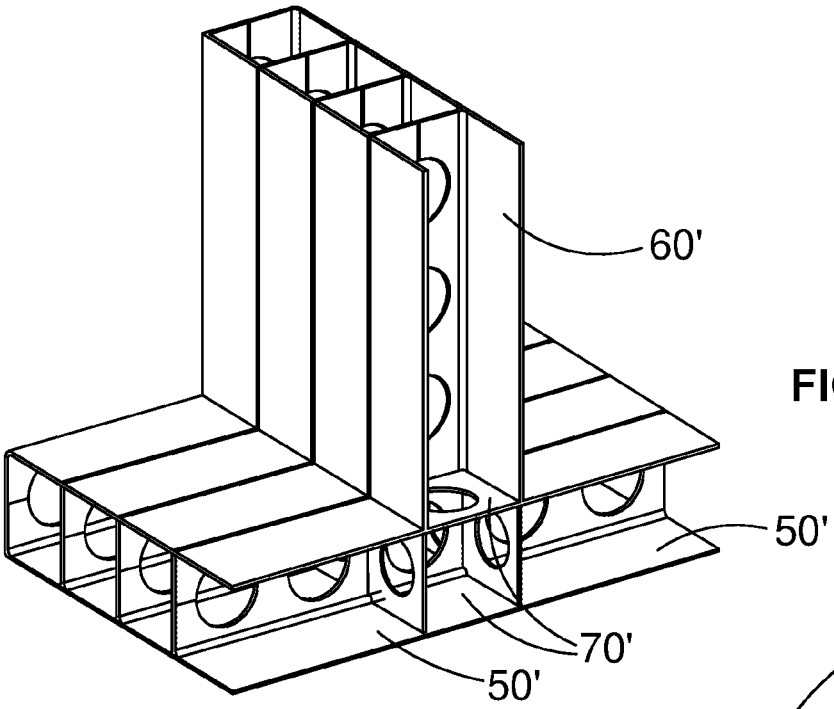
FIGS. 8*a-c* show perspective, top and end views of an alternative joint formed from construction components.
Figure 8B:
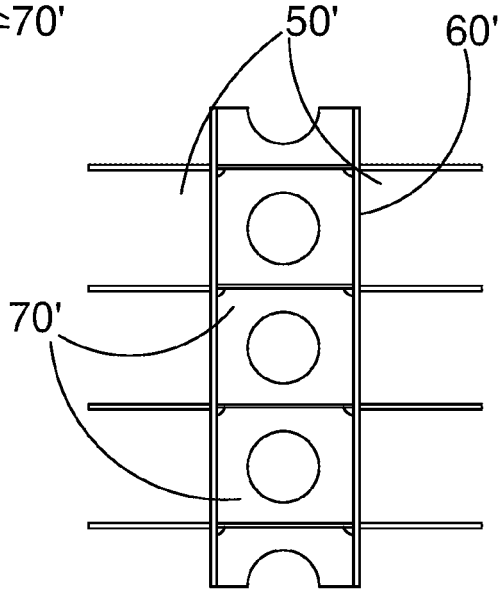
Figure 8C:
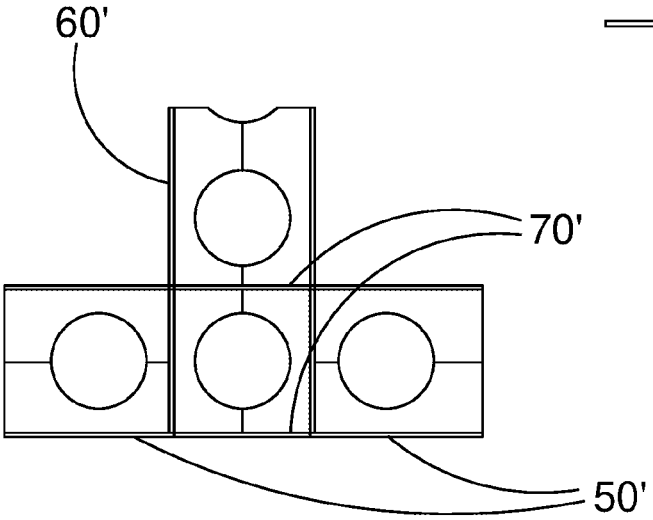

FIGS. 8*a-c* show views of an alternative joint which may be formed between two building components of the kind described above. In this embodiment a T-shaped joint is formed between a pair of horizontal components 50' and a vertical component 60'. The elements which are attached to one another to form the horizontal and vertical components 50',60' are substantially the same as shown in FIGS. 4*a-c*. This joint differs from that shown in FIG. 7 in that here the vertical component 60' is sandwiched between the pair of horizontal components 50', instead of sitting atop a single horizontal component.

As with the joint of FIG. 7 the exact arrangement and positioning of the various components has already been established in the design stage. This means that in order to give the joint additional strength diaphragm support plates can be attached to certain elements where the two components meet one another. In the example shown in FIG. 8 pairs of diaphragm plates 70' are welded into the U-shaped channel of each element making up the vertical component 60'. The diaphragm plates 70' are attached to the vertical elements at the longitudinal locations where the elements making up the horizontal components 50' will rest against the vertical component 60'. Thus, the diaphragm plates 70' are substantially co-planar with the sidewalls of the first element making up the horizontal components 50' so as to give the vertical component 60' additional strength and support in the lateral direction. One or both diaphragm plates in each pair may include openings for concrete flow, or one or both may have no openings. In the illustrated example the lower plate of the pair has no opening whilst the upper plate does have an opening.

Figure 9A:
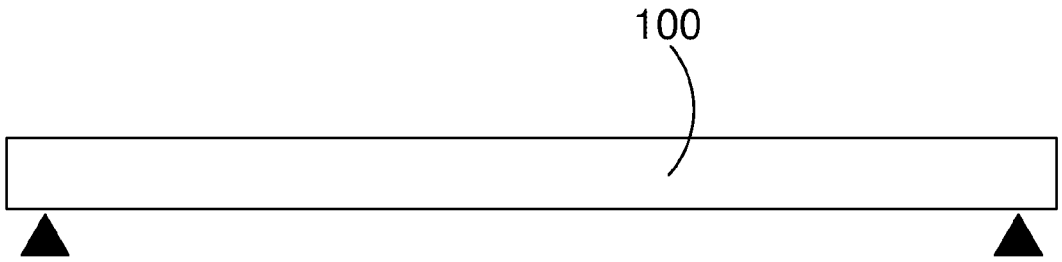
FIGS. 9*a-c* schematically illustrate a method of constructing a reinforced building component using the construction component shown in FIG. 4*c;*
Figure 9B:
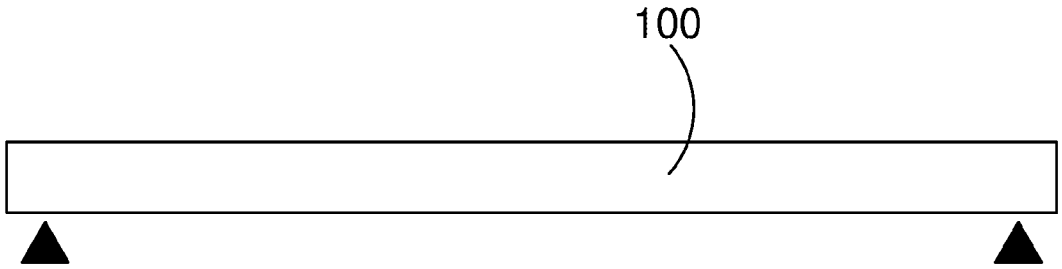
Figure 9C:
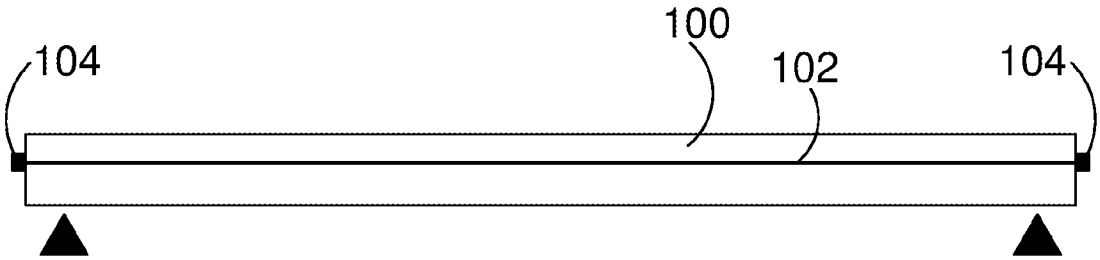

FIGS. 9*a-c* show schematically how a building component of the kind shown in FIG. 4*c* may be employed. In the example shown, a replacement bridge span 100 is formed from a plurality of construction elements of the kind illustrated in FIGS. 4*a* and 4*b*, which are fastened to one another in series. The fastening is preferably achieved by welding adjacent elements together in the manner described above. At least one duct is run through the openings 14*a*,16*a* from one end of the span 100 to the other. One or more tensioning tendons or bars 102 can be inserted in the duct(s) at the manufacturing site or else can be inserted once the component has been transported to the required installation site.

The span 100 is constructed in an off-site manufacturing facility and then transported to the work site, where it is installed as shown schematically in FIG. 9*a*. Once in the correct position concrete is poured into the span 100, with the openings 14*a*, 16*a* in the elements allowing the concrete to flow into and through each element until the interior of the span is filled with concrete. This is shown in FIG. 9*b*.

Once the concrete has hardened the one or more tendons or bars in the duct(s) of the span are tensioned by pulling the tendon or bar ends through anchorages 104 which are fixed to either end of the hardened concrete core. This is seen in FIG. 9*c*. The large forces required to tension the tendons or bars 102 result in a significant permanent compression being applied to the concrete once the tendon is "locked-off" at the anchorage 104. The method of locking the tendon or bar ends to the anchorage is dependent upon the tendon/bar composition, with the most common systems being "button-head" anchoring (for wire tendons), split-wedge anchoring (for strand tendons), and threaded anchoring (for bars).

Figure 10A:
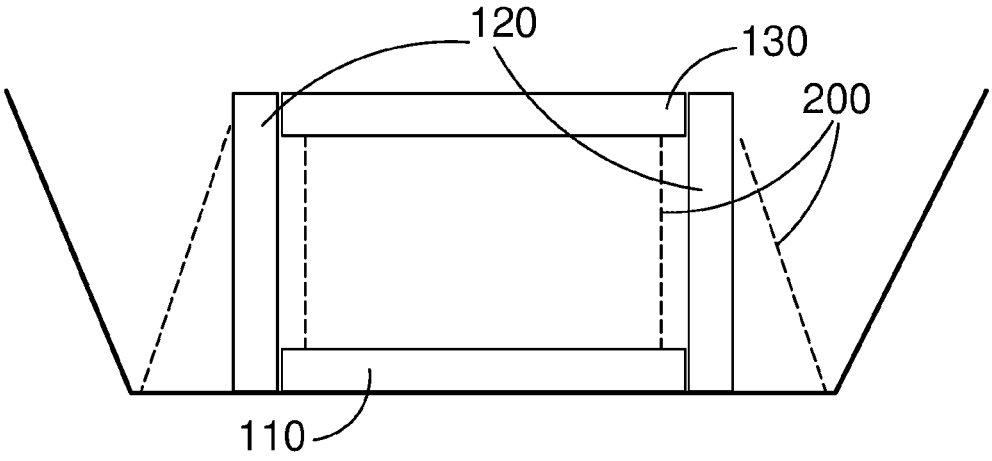
FIGS. 10*a-c* schematically illustrate a method of constructing a reinforced tunnel using the construction component shown in FIG. 4*c*.
Figure 10B:
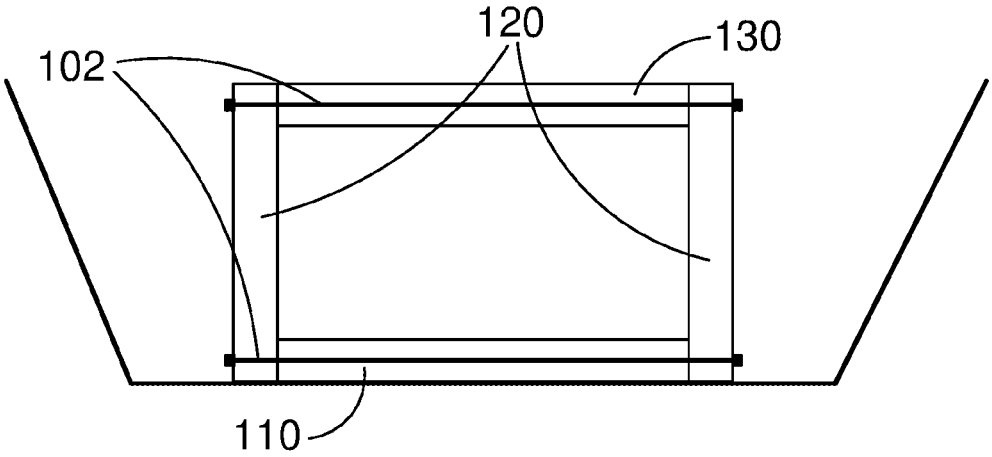
Figure 10C:
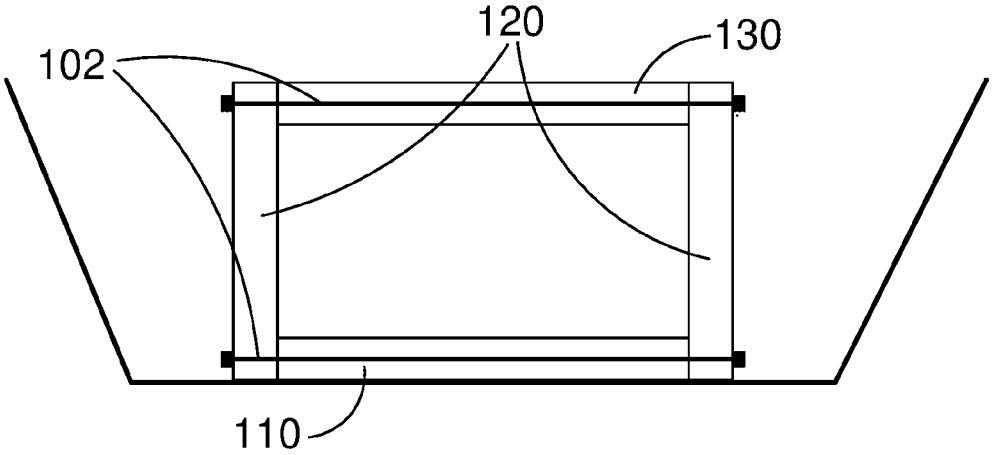

FIGS. 10*a-c* schematically illustrate the construction of a reinforced tunnel using the building components described elsewhere herein. Initially, as shown in figure floor, wall and roof components 110,120,130 are brought to site and arranged as required. Each of the components 110,120,130 is formed from a series of building elements into the final form shown in FIG. 4*c*. A series of temporary props 200 are installed so as to hold the components 110,120,130 in position.

Referring now to FIG. 10*b* tendons or bars 102 are located in the ducts running through the floor and roof components 110,130, and the ends of the tendons/bars are then anchored to the external surfaces of the wall components 120. The tendons/bars 102 are then tensioned such that the components 110,120,130 are held fast together, allowing the temporary props 200 to be removed.

In the final installation stage shown in FIG. 10*c*, each of the floor, wall and roof components 110,120,130 is filled with concrete. Once the concrete has hardened to the required degree the tendons/bars 102 are tensioned further in order to post-tension the concrete. After the post-tensioning has been completed the area outside of the tunnel is back-filled in order to cover it over.

Figure 11A:
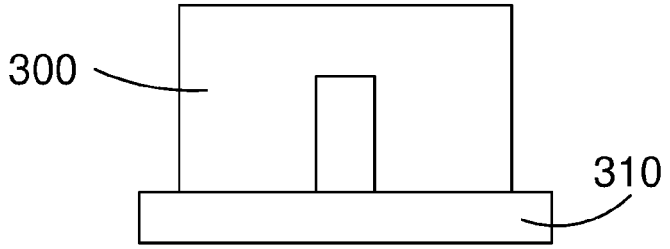
FIGS. 11*a-c* schematically illustrate a method of constructing a building having a reinforced core formed using construction components shown in FIG. 4*c*.
Figure 11B:
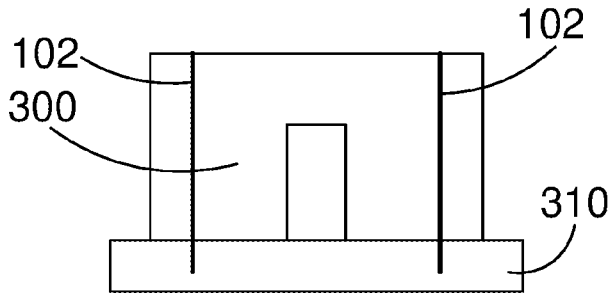
Figure 11C:
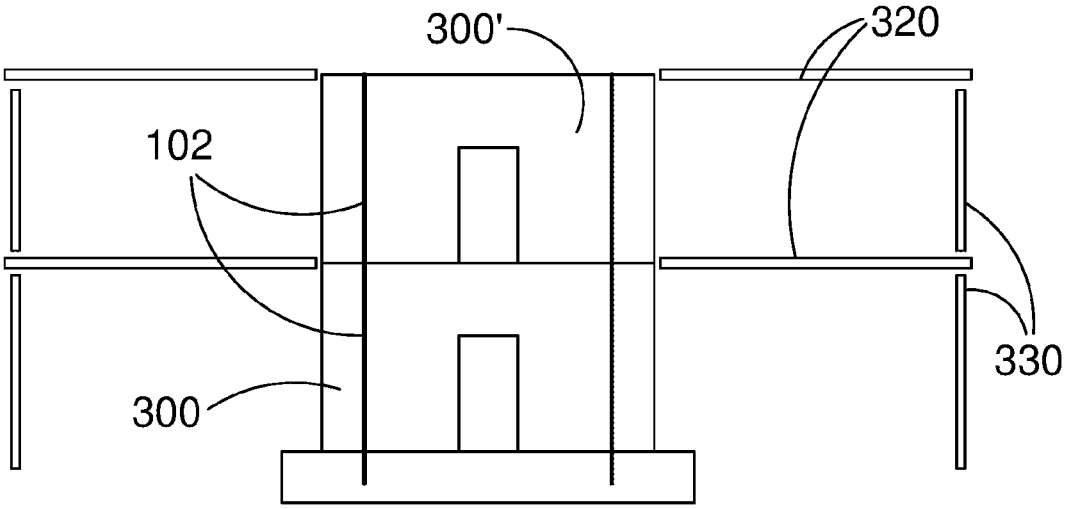

Another construction application is shown schematically in FIGS. 11*a-c*. In this application a reinforced core for a building is to be formed. As seen in FIG. 11*a*, the first stage involves bringing a fabricated core 300 to the site, and installing the core 300 on a foundation 310. The foundation 310 may be formed from concrete or may be formed from a plurality of building elements into a building component of the type described herein. The core 300 is formed from one or more building components of the kind shown in FIG. 4*c*. The core 300 may be a core wall formed from a single component or may instead be a core box made up of a floor component, four wall components and a roof component. However many components are used, each component has at least one duct running through the component in the manner shown in FIG. 4*c*.

In step 2 of the process, seen in FIG. 11*b*, tendons or bars 102 are located in the ducts of the vertical wall component (s). The tendons or bars 102 are anchored at a lower end to the foundation 310 and at an upper end to the roof component or uppermost surface of the wall component(s). The tendons/bars 102 are then tensioned so as to secure and stabilise the core 300 on the foundation 310.

As seen in FIG. 11*c*, additional core components 300' can be placed upon the first core 300 in order to build up the height of the core structure. Each additional level is secured to the layer below by tendons/bars 102 running through the vertical ducts in the vertical components of that new level. The lower ends of the tendons/bars 102 are anchored to the first core component(s) 300 whilst the upper ends are anchored to the roof component or uppermost surface(s) of the new level. An outer framework of beams 320 and columns 330 can be formed and attached to the core structure(s) 300,300' once the core structure is formed. The core stabilises the beams and columns 320,330, allowing construction to be continued on and around the beams and columns.

Once completed, the core 300,300' is filled with concrete to provide additional strength, stiffness and fire resistance. Additional post-tensioning can also be applied, if necessary, via the tendons/bars 102 once the concrete has hardened.

By providing diaphragm support plates at predetermined locations within the elements the complete components can be brought together to form L- or T-shaped joints without any risk of bending or buckling of one or more of the elements. Providing one or more vent holes in a panel of an element allows air to easily escape from the element as concrete flows into the internal volume. This ensures no trapped air pockets and associated structural weakness in the completed components.

When tensioning ducts and associated tendons are employed the present invention provides a versatile lightweight modular construction system capable of being used to form reinforced structural walls, partitions, extended support surfaces, floors, ceilings and roofs, etc. The system enables rapid assembly of a planned construction but is flexible enough to accommodate ad hoc on site changes to meet unforeseen challenges. The modular design also accommodates existing construction practice for pouring concrete, filling with insulation resins etc. without requiring any special training or substantial changes in work practices for installing those secondary construction materials. In more complex structures modular assemblies can be fastened vertically to other modular assemblies in order to form a modular construction system having tiers, floors or levels of modular assemblies. In this way complete structures can be formed having a number of different levels with floors, ceiling and walls all in place. In addition the modular assemblies may be provided with utilities, conduits, ducts, wiring for electrical circuitry and additional structural elements such as to form stairs or the like so that such elements are available on each level of the final structure so that only minimal final construction is required on site.

The tensioning ducts and tendons ensure that the formed reinforced components can be attached to one another without welding, bonding or using large numbers of mechanical fastenings. This means that forming a building or other structure from a number of these reinforced components can be done quicker and cheaper than current methods. This also provides a flexible building system, that can be adapted to changing design requirements.

Each element of the illustrated embodiments is shown as being rectangular but the elements may take other shapes. For instance, the pair of side wall panels making up an element may both be shorter at one end than at the other end. This means that the sidewall panels are tapered or angled. This may allow the element to have a generally triangular shape, which is useful when looking to produce circular reinforced components, for example.

Alternatively, the sidewall panels may be of substantially constant height, but one sidewall panel of the pair may be shorter than the other sidewall panel making up the other side of the U-shaped channel. In other words, when looking into the U-shaped channel from an end of the element one side of the channel is shorter than the other. This arrangement means that if a series of such elements are attached in series as described herein they will define a curve, thus forming a curved building component such as the curved outer wall of a containment structure, for example.

Where present, the diaphragm support plates may have substantially the same surface area as the channel in the U-shaped element into which they are to be installed. As a result, the free edge of the plate which is not fixed into the channel can be fixed to the base panel of an adjoining element when the elements are brought together to form a wall, floor or the like. Alternatively, the support plates may be shorter than the depth of the channel. This means that when adjacent elements are brought together there is a gap between the aforementioned free edge of the support plate and the base panel of the adjoining element. This can allow access behind the plate if additional welding operations are needed during formation of a component made up of a group of the elements.

These and other modifications and improvements may be incorporated without departing from the scope of the present invention.

The invention claimed is:

1. A construction element formed from:

a planar metallic plate subdivided by two parallel fold lines to define three panels, each of the three panels having equal dimensions to the other panels, wherein the panels are deformed out of an initial common plane by bending along their respective fold lines such that the construction element comprises a base panel and two substantially perpendicular sidewall panels which together define a U-shaped channel having an internal cavity, wherein at least one of the panels includes at least one panel opening dimensioned to allow the passage of a reinforcement or stabilising material to fill the internal cavity; and the construction element further comprising:

at least one support plate contained within the U-shaped channel, the at least one support plate having first and second ends fixed to respective sidewall panels and extending substantially perpendicular to both the base panel and the sidewall panels across the channel so as to provide support to the sidewall panels, wherein the at least one support plate includes at least one support plate opening dimensioned to allow the passage of the reinforcement or stabilising material through the support plate.

2. The construction element of claim 1, wherein at least one of the sidewall panels includes a vent adapted to allow air to pass from inside the element to outside the element.

3. The construction element of claim 2, wherein the vent is tapered such that it has a larger diameter on an outside surface of the sidewall panel than on an inside surface of the sidewall panel.

4. The construction element of claim 1, formed from a steel plate having a thickness of between 6 mm and 25 mm.

5. The construction element of claim 1, wherein an internal surface of at least one of the base and sidewall panels includes a plurality of shear studs projecting into the internal cavity.

6. A construction component comprising a modular assembly of a plurality of construction elements according to claim 1, wherein the base panel of one construction element is fastened along distal edges of both sidewall panels of an adjacent construction element so as to form the construction component.

7. The construction component of claim 6, further comprising at least one tensioning duct adapted to receive a tensioning tendon, the at least one tensioning duct extending along the length of the component through the at least one panel opening in each construction element.

8. A method of forming a L- or T-shaped joint from first and second construction elements according to claim 1, the method comprising:

determining first and second abutment locations where ends of the two sidewall panels of the first construction component will abut a sidewall panel of the second construction element when the L- or T-shaped joint is formed;

fixing a pair of support plates across the channel of the second construction element at the first and second abutment locations;

bringing the first and second construction elements together such that the two sidewall panels of the first construction element are substantially co-planar with the respective support plates of the second construction element; and fixing the first and second construction elements together.

9. The method of claim 8, wherein the fixing steps comprise welding, bonding or mechanically fastening the relevant components to one another.

10. A construction element formed from:

first and second planar metallic plates, each plate subdivided by a fold line to define two panels, wherein the panels are deformed out of an initial common plane by bending along their respective fold lines such that the construction element comprises a base panel and two substantially perpendicular sidewall panels which together define a U-shaped channel having an internal cavity, wherein at least one of the panels includes at least one panel opening dimensioned to allow the passage of a reinforcement or stabilising material to fill the internal cavity; and the construction element further comprising:

at least one support plate contained within the U-shaped channel, the at least one support plate having first and second ends fixed to respective sidewall panels and extending substantially perpendicular to both the base panel and the sidewall panels across the channel so as to provide support to the sidewall panels, wherein the at least one support plate includes at least one support plate opening dimensioned to allow the passage of the reinforcement or stabilising material through the support plate.

11. The construction element of claim 10, wherein at least one of the sidewall panels includes a vent adapted to allow air to pass from inside the element to outside the element.

12. The construction element of claim 11, wherein the vent is tapered such that it has a larger diameter on an outside surface of the sidewall panel than on an inside surface of the sidewall panel.

13. The construction element of claim 10, formed from a steel plate having a thickness of between 6 mm and 25 mm.

14. The construction element of claim 10, wherein the element is formed from the first and second planar metallic plates into two separate L-shaped sections that are joined together to form the U-shaped channel.

15. The construction element of claim 14, wherein the two L-shaped sections are shaped such that when they are joined together they define the at least one panel opening.

16. The construction element of claim 14, wherein the two L-shaped sections are joined to one another by welding, bonding or mechanical fastening.

17. The construction element of claim 10, wherein an internal surface of at least one of the base and sidewall panels includes a plurality of shear studs projecting into the internal cavity.

18. A construction component comprising a modular assembly of a plurality of construction elements according to claim 10, wherein the base panel of one construction element is fastened along distal edges of both sidewall panels of an adjacent construction element so as to form the construction component.

19. The construction component of claim 18, further comprising at least one tensioning duct adapted to receive a tensioning tendon, the at least one tensioning duct extending along the length of the component through the at least one panel opening in each construction element.

* * * * *